US009103153B2

(12) United States Patent
Fahl

(10) Patent No.: US 9,103,153 B2
(45) Date of Patent: Aug. 11, 2015

(54) DRIVE DEVICE

(75) Inventor: Daniel Fahl, Hübingen (DE)

(73) Assignee: Stabilus GmbH, Koblenz (DE)

( * ) Notice: Subject to any disclaimer, the term of this patent is extended or adjusted under 35 U.S.C. 154(b) by 1097 days.

(21) Appl. No.: 12/215,557

(22) Filed: Jun. 27, 2008

(65) Prior Publication Data

US 2009/0000201 A1 Jan. 1, 2009

(30) Foreign Application Priority Data

Jun. 27, 2007 (DE) ..... 10 2007 029 591

(51) Int. Cl.
*E05F 15/02* (2006.01)
*E05F 15/622* (2015.01)

(52) U.S. Cl.
CPC ..... *E05F 15/622* (2015.01); *E05Y 2201/21* (2013.01); *E05Y 2201/242* (2013.01); *E05Y 2201/26* (2013.01); *E05Y 2201/266* (2013.01); *E05Y 2900/546* (2013.01)

(58) Field of Classification Search
CPC ..... B60J 5/10; B60J 5/101; B60J 5/106; E05F 5/00; E05F 5/02; E05F 5/022; E05F 5/04; E05F 15/12; E05F 15/122; E05F 15/124; F16D 51/00; F16D 51/10; F16D 51/12; F16D 51/16; F16D 51/18; F16D 51/20; F16D 51/22
USPC ..... 49/339, 340, 341, 342, 343; 192/215; 188/72.7, 72.8, 73.1, 158–162
See application file for complete search history.

(56) References Cited

U.S. PATENT DOCUMENTS

| | | | | | |
|---|---|---|---|---|---|
| 4,434,951 | A * | 3/1984 | Nakajima | 242/288 |
| 4,500,048 | A * | 2/1985 | Schaller | 242/381.5 |
| 4,788,463 | A * | 11/1988 | Layh | 310/77 |
| 5,785,069 | A * | 7/1998 | Glatz | 135/20.1 |
| 6,126,105 | A * | 10/2000 | Yamaguchi | 242/288 |
| 7,234,757 | B2 * | 6/2007 | Mitchell | 296/146.8 |
| 7,618,003 | B2 * | 11/2009 | Rho | 242/288 |
| 7,850,109 | B2 * | 12/2010 | Sung | 242/288 |
| 2007/0062119 | A1 | 3/2007 | Ritter | |
| 2007/0175099 | A1 | 8/2007 | Kachouh | |

FOREIGN PATENT DOCUMENTS

| | | | |
|---|---|---|---|
| DE | 10 2005 030 052 | 12/2006 | |
| DE | 20 2005 020 087 | 5/2007 | |
| EP | 0 305 719 | 3/1989 | |
| JP | 1-107194 | 4/1989 | |
| JP | 2007-10146 | 1/2007 | |
| WO | WO 9214377 A1 * | 9/1992 | A45B 25/14 |

* cited by examiner

*Primary Examiner* — Katherine Mitchell
*Assistant Examiner* — Catherine A Kelly
(74) *Attorney, Agent, or Firm* — Cozen O'Connor

(57) ABSTRACT

A drive device for a hatch of a vehicle, wherein the device includes a first housing part which can be connected to a stationary component or to a movable component, a second housing part, a third housing part which is telescopically guided in the second housing part with an axial freedom of movement and which can be connected to the other of the movable component or the stationary component. A spindle drive comprising a threaded spindle and a spindle nut is mounted on the threaded spindle, by which the third housing part can be driven by a rotary drive and, thus, moved axially with respect to the second housing part. The drive device also includes a brake device, where the brake device comprises a centrifugal force brake.

13 Claims, 4 Drawing Sheets

DRIVE DEVICE

BACKGROUND OF THE INVENTION

1. Field of the Invention

The invention is directed to a drive device for a hatch of a motor vehicle having a first housing part, which can be connected to a stationary component or to a movable component, a second housing part, and a third housing part, which is guided in the second housing part with freedom of telescopic movement, and which can be connected to a movable component or to a stationary component. The drive device also includes a spindle drive comprising a threaded spindle and a spindle nut mounted on the threaded spindle, by which the third housing part can be driven by a rotary drive and thus moved axially with respect to the second housing part, and a brake device.

2. Description of the Related Art

In conventional drive devices, it should be possible not only to allow the drive device to move the hatch of a vehicle automatically but also to move the hatch manually. Here, the manual forces required for moving the hatch should be as low as possible. Simultaneously, the force which holds the hatch open against the effect of additional loads, such as those exerted by snow, wind, etc., should remain reliably guaranteed.

One disadvantage associated with such conventional drive devices is that the cooperating brake elements of these types of devices do not completely release each other during the operation of the rotary drive and, thus, are subject to unnecessary wear or are complicated in design.

SUMMARY OF THE INVENTION

It is an object of the invention to create a drive device of the type described above which overcomes the previously cited disadvantages. This and other objects and advantages are achieved by the drive device in accordance with invention by providing a brake device which comprises a centrifugal force brake that is configured as a magnetic centrifugal force brake such that an especially simple design becomes possible. In an embodiment, the brake device comprises a first brake element and at least one second brake element. Here, the first brake element is supported on the rotary drive to guarantee especially reliable operation. The first brake element comprises a bore with a step, where the step provides a support surface for a magnet, which provides a considerable space savings.

In an embodiment, a magnetic ring is used as the magnet to advantageously save space. In another embodiment, the brake device comprises a guide device, where the second brake elements are located in the guide device. Here, the guide device is mounted on the drive shaft of the rotary drive such that it cannot twist to ensure satisfactory operation.

In another embodiment, each of the second brake elements comprise a recess and the guide device comprises guide elements, where the guide elements engage in the recesses to advantageously ensure that the entire surface of the second brake elements makes contact with the first brake element. Alternatively, the first brake element can be configured in the form of a cup, where the magnetic ring is mounted in the cup. In a particularly advantageous embodiment, openings are provided in the cup, which ensure better magnetic flux propagation. In another embodiment, a flange-like section is formed at the open end of the cup. With the help of this section, the brake device can be attached in a space-saving manner.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Exemplary embodiments of the invention are illustrated in the drawings and are described in greater detail below.

DETAILED DESCRIPTION OF THE PRESENTLY PREFERRED EMBODIMENTS

Figure 1:
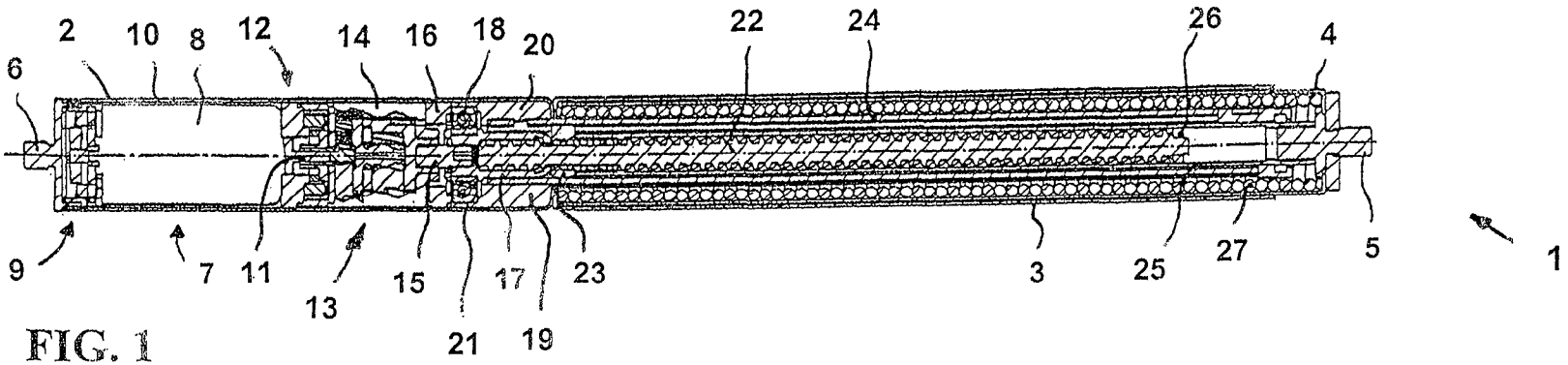
FIG. 1 shows a cross section through a drive device in accordance with the invention.
Figure 6:
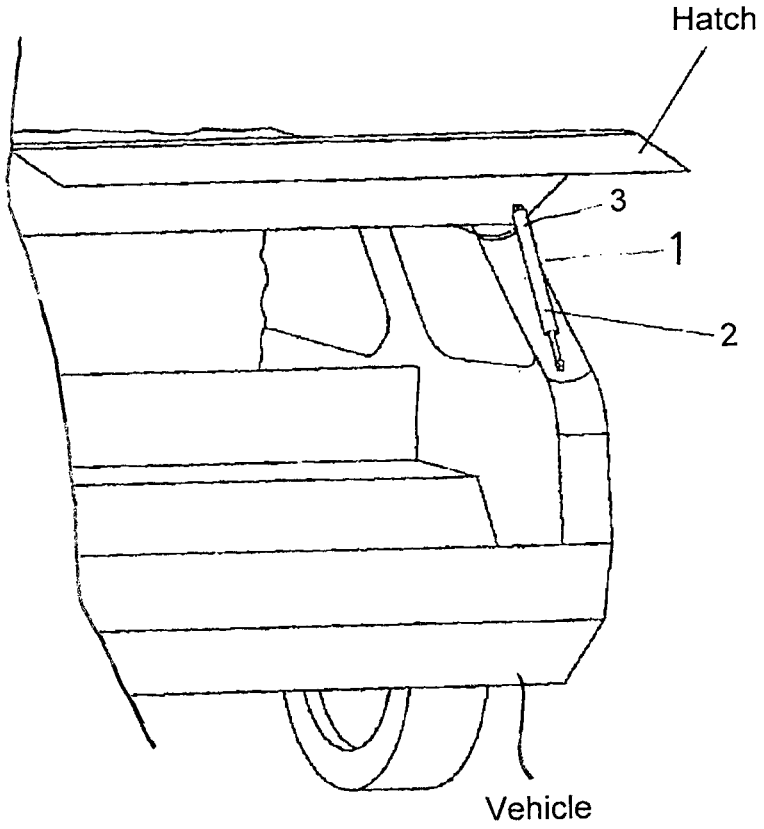
FIG. 6 shows the drive device of FIG. 1 attached in an articulated manner to a stationary body component of a motor vehicle and to a movable component of the motor vehicle.

The drive device 1 shown in FIG. 1 has a first housing part 2, a second housing part 3, and a third housing part 4, which is telescopically guided in the second housing part 3 with an axial freedom of movement. A first connecting device 5 is mounted on the end of the third housing part 4 opposite the first housing part 2, and a second connecting device 6 is mounted on the end of the housing part 2 opposite the third housing part 4. The connecting devices 5 and 6 close off the ends of their respective housing parts 2 and 3. The connecting devices 5 and 6 have threads (not shown), so that they can be screwed onto connecting elements (not shown) in the form of ball sockets. The person of ordinary skill in the art, however, will appreciate that connecting techniques can also be used to connect the connecting devices 5 and 6 to the connecting elements, such as welding or creasing. As a result, the drive device can be attached in an articulated manner to a stationary body component of a motor vehicle and to a movable component of the motor vehicle, such as a hatch (see FIG. 6).

A rotary drive 7 is installed in the first housing part 2 at the end facing the second connecting device 6. The rotary drive 7 comprises an electric motor 8, which is supported by a retaining device 9 on the end of the first housing part 2 which is closed off by the connecting device 6 and which can be held coaxially in place in the first housing part 2 by another, cylindrical retaining device 10. A drive shaft 11 extends coaxially from the motor 8, through a brake device 12 and to a gear unit 13. In the preferable embodiment, the gear unit 13 is a two-stage planetary gear. It should be appreciated, however, that other types of gear units are also possible. A coaxial gear shaft 15 extends from the gear housing 14 and passes through a retaining device 16, which holds the assembly consisting of the electric motor 8, the brake device 12 and the gear unit 13 in place in the axial direction.

An adapter sleeve 17 is mounted at the end of the gear shaft 15 and is supported in a bearing 18. The bearing 18 is supported at one end on the retaining device 16 and is held in position by a guide bush 19. The section of the guide bush 19 extending from the end of the first housing part 2 directly adjacent to the second housing part 3 to the bearing 18 has a thicker wall section 20, whereas a thinner wall section 21 is present between the thicker wall section 20 and the retaining device 16.

The adapter sleeve 17 connects the gear shaft 15 to a threaded spindle 22; serrations or a creasing technique can be used, for example, to establish this connection. The threaded spindle 22 extends from the end of the first housing part 2 facing the second housing part 3 into the second housing part 3. In an embodiment, a sensor device (not shown) or a clutch is installed inside the first housing part 2.

A spindle nut 23 is mounted on the threaded spindle 22. The threaded spindle 22 and the spindle nut 23 are installed in a guide tube 24, which extends essentially through the entire second housing part 3 and into the first housing part 2, so that the guide tube 24 also projects into the guide bush 19. The guide tube 24 has at least one axially oriented groove, which can be designed as a slot, into which the spindle nut 23 can engage while remaining free to move in the axial direction without rotating.

The spindle nut 23 guides the axial movement of a spindle tube 25 in the guide tube 24, where the spindle tube 25 is supported at one end on the spindle nut 23. The first connecting device 5 is attached to the other end of the spindle tube 25. At the end near the first connecting device 5, the threaded spindle 22 has a guide ring 26 which is mounted in the spindle tube 25. This ring prevents the threaded spindle 22 from oscillating radially.

The third housing part 4 extends axially from the first connecting device 5 into the second housing part 3. A spring device 27 comprising a helical compression spring also extends axially from the first connecting device 5 or from the third housing part 4 attached to the first connecting device 5 and is supported on the end of the second housing part 3 adjacent to the first housing part 2. For this purpose, the end of the second housing part located proximal to the first housing part 2 is flanged over, or a ring-shaped element is formed thereon or screwed to it, so that an opening is created, through which the threaded spindle 22 and the guide tube 24 can pass.

Figure 2:
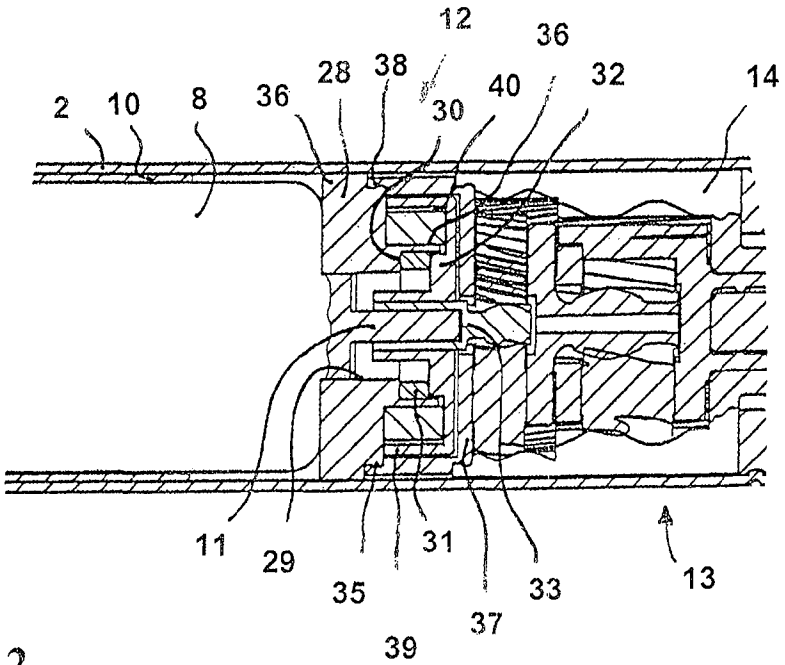
FIG. 2 shows a portion of the drive device shown in FIG. 1.

FIG. 2 shows a portion of the drive device 1 shown in FIG. 1. In particular, FIG. 2 shows the brake device 12 located in the drive device between the motor 8 and the gear unit 13. The brake device 12 comprises a first brake element 28 which is supported on the motor 8 without any freedom to rotate on the drive shaft. In the preferred embodiment, the brake device 12 consists of non-magnetizable material, such as plastic or aluminum. This first brake element 28 has a bore 29, through which the drive shaft 11 of the motor 8 passes. The first brake element 28 has a step 30 in the bore 29; this step serves as a support surface for a magnetic ring 31. A guide device 32, preferably consisting of nonmagnetizable material, such as plastic or aluminum, ensures that the magnetic ring 31 is held in place. For this purpose, the side of the magnetic ring 31 opposite the step 30 rests against the guide device 32. The guide device 32 is connected by an adapter device 33 to the drive shaft 11 of the motor such that the guide device 32 rotates along with the drive shaft 11.

The first brake element 28 has a first section 34 (see FIG. 4) adjacent to the motor 8; the outside diameter of this first section 34 is essentially the same as the inside diameter of the first housing part 2. Adjacent to the first section 34 is a second section 35 (FIG. 2) of reduced outside diameter, and adjacent to the second section 35 is a third section 36 of even further reduced diameter.

The step formed at the transition from the first section 34 to the second section 35 provides a support surface for a cover 37 of the gear housing 14. The cover 37 has a coaxial opening, through which the drive shaft 11 is guided to the gear unit 13. From the outside circumference of the cover 37 there proceeds a wall 38, which is an integral part of the cover, and which extends as far as the first section 34 of the first brake element 28.

The step which is formed at the transition from the second section 35 to the third section 36 provides a support surface for a wall 39 of the guide device 32, which has a cup-like shape similar to that of the cover 37. Consequently, a ring-shaped chamber 40 is formed between the wall 39 of the guide device 32 and the third section 36 of the first brake element 28, into which at least one second brake element 41 is inserted. In the preferred embodiment, the second brake element 41 is a brake shoe. Preferably, two or more second brake elements 41 are installed in this chamber to ensure that the braking force is applied uniformly. As shown cross sectionally, the radial extent of the chamber 40 is larger than that of the second brake elements 41. The second brake elements 41 can thus separate completely from the first brake element 28 in the radial direction.

Figure 3:
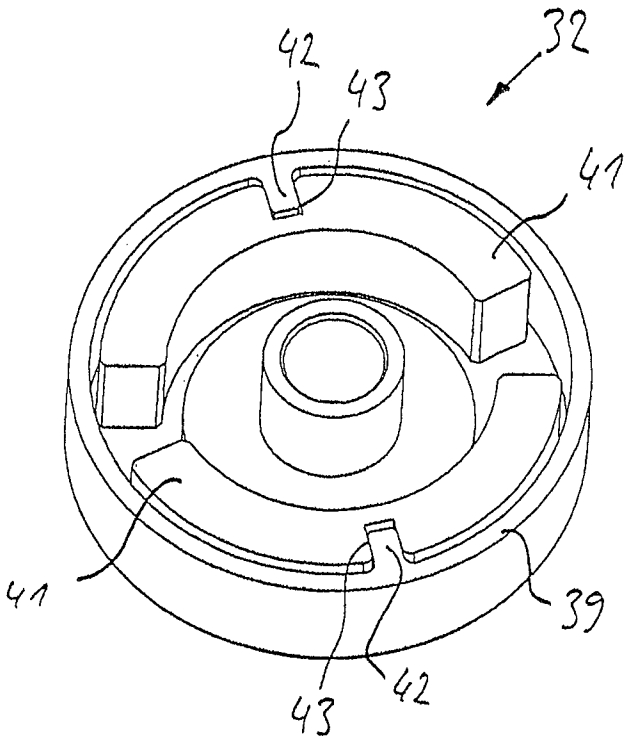
FIG. 3 shows a detailed view, in isolation, of a component of the portion of the drive device shown in FIG. 2.

In order to permit the second brake elements 41 to rotate together with the guide device 32 and, therefore, shift in the radial direction, the guide device 32 preferably comprises a guide element 42 for each of the second brake elements 41; these guide elements can be seen in detail in FIG. 3.

FIG. 3 shows a detailed diagram of the guide device 32, into which two radially movable second brake elements 41 are inserted. Two opposite guide elements 42, which have a web-like shape, project radially inward from the wall 39. The person of ordinary skill in the art would appreciate that more than two guide elements 42 could be provided on the wall 39 to project into the interior of the guide device 32, and that the corresponding number of second brake elements 41, i.e., one for each guide device 32, could be provided. Each of the second brake elements 41 has a recess 43 on the side facing the wall 39; the guide elements 42 project into these recesses and ensure that, first, the second brake elements 41 can rotate along with the guide device 32 and, second, that the elements can move in the radial direction. It is also ensured that the sides of the second brake elements 41 facing the first brake element 28, i.e., the braking surfaces, rest completely on the second brake element 28.

Figure 4:
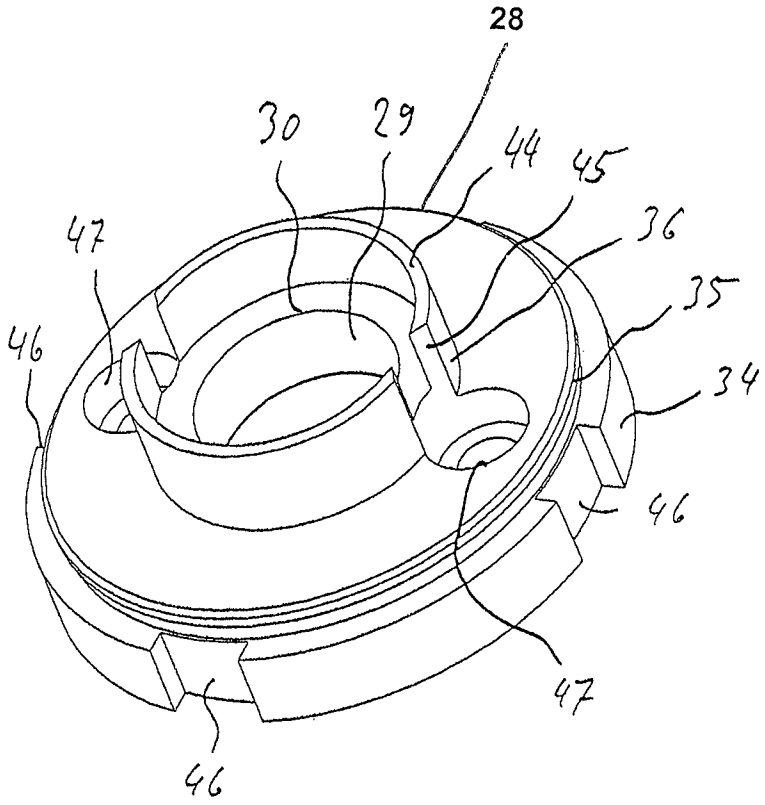
FIG. 4 shows a detailed view, in isolation, of another component of the portion of the drive device shown in FIG. 2.

FIG. 4 shows a detailed view of the first brake element 28 of FIG. 2. As previously described, the first brake element 28 has three sections 34-36 with different outside diameters. The second section 35 has a smaller outside diameter than the first section 34, and the third section 36 has a smaller outside diameter than the second section 35. A bore 29 extends through the first brake element 28, where a step 30 is formed in the bore 29, essentially in the area of the third section 36, so that the bore 29 comprises a larger diameter in a certain part of the third section 36. The third section 36 therefore comprises a sleeve-like wall 44, in which preferably several openings 45 are formed. The openings 45 ensure that magnetic flux can flow more easily from the magnetic ring 31 to the second brake elements 41 and from the second brake elements 41 to the magnetic ring 31.

In the first section 34 of the first brake element, several recesses 46 are formed in the lateral exterior surface, into which parts of the wall 38 of the cover 37 mounted on the gear housing 14 engage, thus forming an anti-rotation device and providing axial support. Furthermore, two bores 47 extend through the first section 34. Screws (not shown), which connect the first brake element 28 to the motor 8, can be inserted through bores 47.

Figure 5:
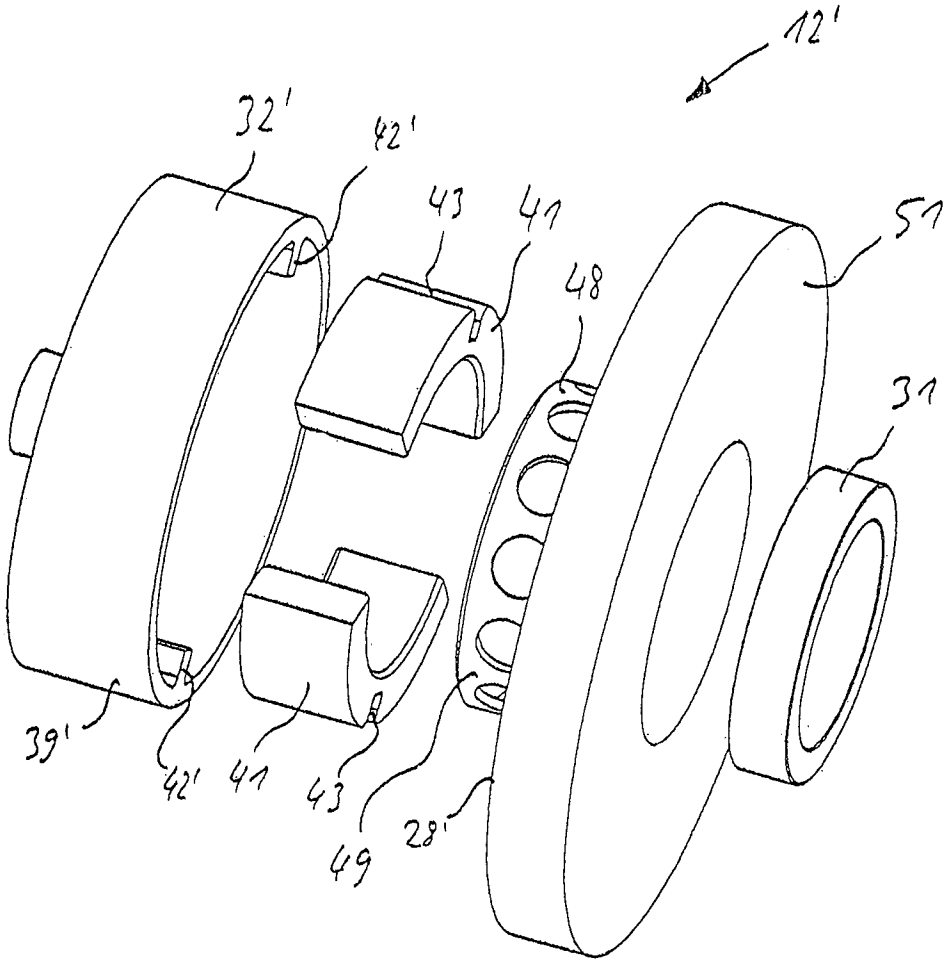
FIG. 5 shows another exemplary embodiment of the drive device in accordance with the invention.

FIG. 5 shows a brake device 12' according to another exemplary embodiment of the present invention. Here, the brake device 12' comprises a guide device 32' with two opposing guide elements 42', which project radially inward from the wall 39'.

On the side facing the wall 39', each of the second brake elements 41 has a recess 43, into which the guide elements 42' project. This ensures that, first, the second brake elements 41 rotate along with the guide device 32' and, second, that the second brake devices 41 are movable in the radial direction. The first brake element 28' is cup-shaped and comprises a cup 48, into which the magnetic ring 31 is inserted. The magnetic ring 31 is preferably captured or held in the cup by means of a press-fit. It is also possible, however, for the magnetic ring 31 to be bonded in place with an adhesive or held in the cup by a cover. Openings 50 are provided in a wall 49 of the cup 48. The openings 50 make it possible for the magnetic flux to pass more easily from the magnetic ring 31 to the second brake elements 41 and from the second brake elements 41 to the magnetic ring 31. A flange-like section 51 is formed at the open end of the wall 49, where the outside diameter of the flange-like section 51 is essentially the same as the inside diameter of the housing part 2 shown in FIGS. 1 and 2. By means of the flange-like section 51, the first brake element 28' can be mounted in the housing 2 such that it cannot rotate or move in the axial direction relative to the housing 2.

In drive devices in accordance with the contemplated embodiments, it is desirable for the drive device to open the hatch of a vehicle reliably and to keep it open. Nevertheless, it should also be possible to open the hatch manually. Thus, the spring device 27 assists the opening or the keeping-open of the hatch by compensating for almost the entire weight of the hatch. To provide additional holding force, which ensures that the hatch is kept open when the weight conditions change, which can occur, for example, as the result of wind or snow, the second brake elements 41 rest on the first brake element 28, 28' when the motor 8 is stopped and, thus, generate a braking moment, which is made even stronger by the gear unit 13.

When the motor 8 is turned on, the braking force acting on the first brake element 28, 28' by means of the second brake elements 41 is first overcome, and then the guide device 32, 32' is caused to rotate. The centrifugal forces now acting on the second brake elements 41 act in opposition to the magnetization force applied by the magnetic ring 31. As a result, the second brake elements 41 separate completely from the first brake element 28, 28'.

When the motor 8 is turned off, the centrifugal forces acting on the second brake elements 41 decrease, and the magnetizing force generated by the magnetic ring 31 can pull the second brake elements 41 toward the first brake element 28, 28', which causes an additional holding force to once again act on the drive device 1.

During manual actuation such as when the hatch is opened or closed by hand, the threaded spindle 22 is caused to rotate, and because of the gear unit 13, the guide device 32, 32' is also rotated. The centrifugal forces then acting on the second brake elements 41 act in opposition to the magnetizing force applied by the magnetic ring 31. As a result, the second brake elements 41 separate completely from the first brake element 28, 28'.

When the hatch is not moved further, the centrifugal forces acting on the second brake elements 41 decrease, and the magnetizing force generated by the magnetic ring can pull the second brake elements 41 toward the first brake element 28, 28', which causes additional holding force once again acts on the drive device 1.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A drive device for a hatch of a vehicle, comprising:

a first housing part connected to one of (i) a stationary body component of the vehicle or (ii) a movable component comprising the hatch of the vehicle;

a second housing part;

a third housing part which is telescopically guided in the second housing part with an axial freedom of movement, said third housing part being connected to another of (i) the movable component comprising the hatch of the vehicle or (ii) the stationary body component of the vehicle;

a spindle drive comprising a threaded spindle and a spindle nut mounted on the threaded spindle by which the third housing part is drivable by a rotary drive to move axially with respect to the second housing part; and a brake device comprising a centrifugal force brake including a first brake element and at least one second brake element, the brake device being disengaged when the at least one second brake element is drawn away from the first brake element by centrifugal forces applied to the brake device when the vehicle hatch is moved.

2. The drive device according to claim 1, wherein the brake device comprises a magnetic centrifugal force brake.

3. The drive device according to claim 1, wherein the first brake element is supported on the rotary drive.

4. The drive device according to claim 3, wherein the first brake element comprises a bore with a step, where the step provides a support surface for a magnet.

5. The drive device according to claim 4, wherein the magnet is a magnetic ring.

6. The drive device according to claim 1, wherein the brake device further comprises a guide device.

7. The drive device according to claim 6, wherein the at least one second brake element is installed in the guide device.

8. The drive device according to claim 6, wherein the guide device is mounted on a drive shaft of the rotary drive without any freedom to rotate relative to the drive shaft.

9. The drive device according to claim 7, wherein the at least one second brake element includes a recess, and the guide device includes guide elements which engage in the recess, the guide elements and the recess allowing radial movement of the at least one second brake element relative to the guide device.

10. The drive device according to claim 1, wherein the first brake element is formed as a cup.

11. The drive device according to claim 10, wherein the magnetic ring is installed in the cup.

12. The drive device according to claim 11, wherein openings are provided in the cup facilitating the passing of magnetic flux between the magnetic ring and the at least one second brake element.

13. The drive device according to claim 10, wherein a flange section is formed at an open end of the cup.

* * * * *